US008607381B2

(12) United States Patent
Woods et al.

(10) Patent No.: US 8,607,381 B2
(45) Date of Patent: Dec. 17, 2013

(54) YOGA MAT

(76) Inventors: Catherine A. Woods, Robbinsville, NC (US); Robert F. Woods, Robbinsville, NC (US)

( * ) Notice: Subject to any disclaimer, the term of this patent is extended or adjusted under 35 U.S.C. 154(b) by 0 days.

(21) Appl. No.: 13/368,911

(22) Filed: Feb. 8, 2012

(65) Prior Publication Data

US 2012/0210512 A1 Aug. 23, 2012

Related U.S. Application Data

(60) Provisional application No. 61/444,381, filed on Feb. 18, 2011.

(51) Int. Cl.
*A47G 9/06* (2006.01)

(52) U.S. Cl.
USPC ..... 5/420; 5/417; 5/655.9; 5/657

(58) Field of Classification Search
USPC ..... 5/630, 632, 636, 652, 417, 420, 722, 5/902
See application file for complete search history.

(56) References Cited

U.S. PATENT DOCUMENTS

| | | | | |
|---|---|---|---|---|
| 2,751,609 | A * | 6/1956 | Oesterling et al. | 5/420 |
| 3,222,695 | A | 12/1965 | Brown | |
| 4,766,626 | A * | 8/1988 | Green | 5/420 |
| 5,051,293 | A * | 9/1991 | Breitscheidel et al. | 428/157 |
| 5,669,089 | A * | 9/1997 | Dees | 5/419 |
| 2006/0073305 | A1 | 4/2006 | Kole | |
| 2007/0226904 | A1 | 10/2007 | Huffman | |
| 2009/0241260 | A1 | 10/2009 | Noonan | |
| 2010/0306917 | A1 * | 12/2010 | Batiste | 5/420 |

FOREIGN PATENT DOCUMENTS

| | | | | |
|---|---|---|---|---|
| GB | 2182556 A * | 5/1987 | | A47C 27/14 |

* cited by examiner

*Primary Examiner* — Michael Trettel
(74) *Attorney, Agent, or Firm* — Kilpatrick Townsend & Stockton LLP

(57) ABSTRACT

Embodiments of the present invention provide an improved yoga or exercise mat shape that allows instructors and students to see each other in all yoga poses without re-positioning mats. The mat shape also ensures that the participants maintain all body parts on the mat during all poses. The mat is further provided as a one-piece configuration to allow an easy and hassle-free set up and use experience.

13 Claims, 15 Drawing Sheets

YOGA MAT

CROSS REFERENCE TO RELATED APPLICATIONS

This application claims the benefit of U.S. Provisional Application Ser. No. 61/444,381, filed Feb. 18, 2011, titled "Yoga Mat," the entire contents of which are hereby incorporated by reference.

FIELD OF THE INVENTION

Embodiments of the present invention relate generally to mats, and particularly to exercise or yoga mats having improved configurations.

BACKGROUND

The use of a flexible mat that can be rolled out for use during a yoga or other exercise class and then rolled back up once the class is complete is common. These mats are intended to protect the user from slipping on the floor or from otherwise touching or laying on the floor, which can be uncomfortable and unsanitary. Yoga mats are often referred to as "sticky mats" because they also have a textured surface that can help prevent slipping.

Yoga and other exercise mats are typically designed as a straight, elongate strip of material. This creates a number of challenges. For example, because yoga classes often involve a number of poses and stretches that involve various twists and positions, it is inevitable that at some point, the students will turn to face various sides of the studio in order to stay on their mats. This results in the students not being able to face or otherwise see the instructor during certain poses. Examples of such difficulties are shown in FIG. 1. For example, for poses that face forward (e.g., such as Warrior I, Mountain pose, sun salutations) the student and instructor can face one another as shown in FIGS. 1A and 1B. However, for a pose that requires the participants to turn to the side in order to stay on the mat as shown in FIG. 1C (e.g., such a triangle pose), the student and instructor no longer face one another.

If the mats are instead turned the other way, the same problem exists in reverse, as shown in FIG. 2. With the mats sideways, student and instructor face each other in FIG. 2A (Goddess pose), but not in FIGS. 2B and 2C. In short, it does not matter which way a traditional yoga or exercise mat is positioned—there will always be some poses where the student and instructor are not facing one another. Of course, flipping the mats back and forth for the various poses during a class destroys the class flow, takes time, and is impractical.

In addition to the above problems, the use of straight yoga mats can also cause various physical strains on the participants. If an instructor is demonstrating a posture, and because of the direction of the mat, turns his/her head to view the students' progress, the instructor may strain a neck or back muscle due to the twisted turn. The same problem can happen when students turn to see the instructor during a pose, which can move them out of proper and safe body alignment (an example of which is shown in FIG. 14C). If, in order to solve the problem, the instructor moves to a different location without a mat, the instructor no longer has the safety and comfort benefits of the mat. And placing multiple mats around the room at various positions for the instructor to use during various poses can create a messy, unsafe, and confusing atmosphere.

Additionally, many studios have hard wood floors. Often, these floors are uncomfortable in certain poses, and some sort of padding would be preferable. Frequently, students will fold up a blanket to place under knees, ankles, head, elbows or they will double up mats, resulting in either the students or the studio having to purchase, maintain, and navigate these additional products. Nonetheless, it has been typically the standard to simply live with these challenges, as there has not been provided a realistic and viable solution.

One attempted solution has been to use two mats, one laid on top of the other in a crosswise or opposite direction, as shown in the right side photo of FIG. 2D. However, this causes a potential tripping hazard, mat slippage, as well as a bulky and uneven center area where the two mats overlap one another. It also requires the purchase of two mats, and having to carry, roll, unroll, and store two mats. If mats are provided by the studio, if requires the studio to maintain double the inventory with twice as many mats to store and sanitize. If the student chooses to lay two mats on top of each in the same direction to create extra padding, similar problems result.

Other solutions have been to provide very large square or oval mats, some as large as six feet across. The size of these mats helps the user stay on the mat during the entire exercise experience, but they are large, expensive, unwieldy to store, and take up a good deal of space in a class, potentially limiting student size.

A further attempted solution has been to create a yoga mat having an alternate shape. One design that has been considered is a mat having equidistant arms that extend out from the midpoint of a straight mat, much like a plus-sign as shown in FIG. 3. One problem with such a design is that in the T-pose, where the participant lays flat on his/her back with arms outstretched, the legs would extend off of the mat.

Another attempted solution has been to create a mat having a capital T-shape, as shown in FIG. 4. This mat is designed primarily for push-ups, in order to provide the user a place to put his/her outstretched hands instead of on the floor. The problem with using such a mat for yoga is that in the T-pose, where the participant lays flat on his/her back with arms outstretched, the arms would extend off of the mat.

A final design attempt has been to create a yoga mat having wing shapes that extend from a straight mat, but the wings are described as separate pieces that are attached to the mat with woven material or hook and loop fastener. The problem with this design is that the user has to keep track of multiple pieces, and rolling the mat can be a challenge.

Accordingly, there is still a need in the art for a simple and elegant solution to the above problems.

BRIEF SUMMARY

Embodiments of the present invention provide an improved yoga or exercise mat in the shape of a cross, as opposed to a traditional straight yoga mat. Use of the mat in a yoga class situation allows the instructor and students to see each other at all times, in all yoga postures. The mat also prevents the participants from having to face sideways during class, from touching the floor during certain postures, and from having to turn and twist or otherwise move about the room in order to see one another.

BRIEF DESCRIPTION OF THE FIGURES

FIGS. 1-2 show various instructor/student positions in a number of yoga postures done on traditional yoga mats.

DETAILED DESCRIPTION

Embodiments of the present invention provide an improved yoga or exercise mat shape that allows instructors and students to see each other in all yoga poses without re-positioning mats. The mat shape also ensures that the participants maintain all body parts on the mat during all poses. The mat is further provided as a one-piece configuration to allow an easy and hassle-free set up and use experience.

This document will describe mats for use with yoga (and it has been found that they are particularly useful during yoga classes), but it should be understood that the mats described herein may be used for any appropriate activity, such as any other types of exercises (e.g., pushups, sit-ups, Pilates, and so forth), meditation mats, child naps, story time mats, sunbathing, beach mats, massage mats, school gymnasium mats, book store mats, or any other appropriate activity that benefits from its participants using a mat or pad to prevent direct contact with a floor or other surface.

Figure 1A:
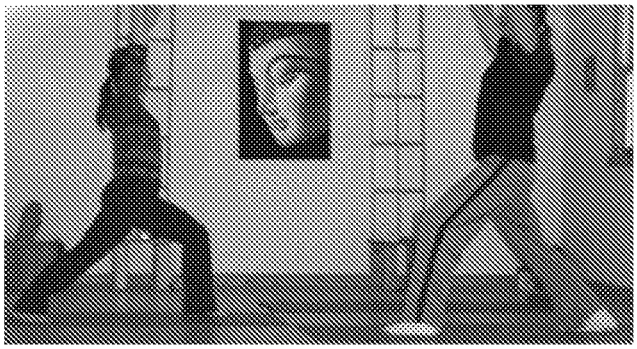
FIG.1A Prior art
FIGS. 1A-1C show yoga positions on a traditional yoga mat in a forward-facing position.
Figure 1B:
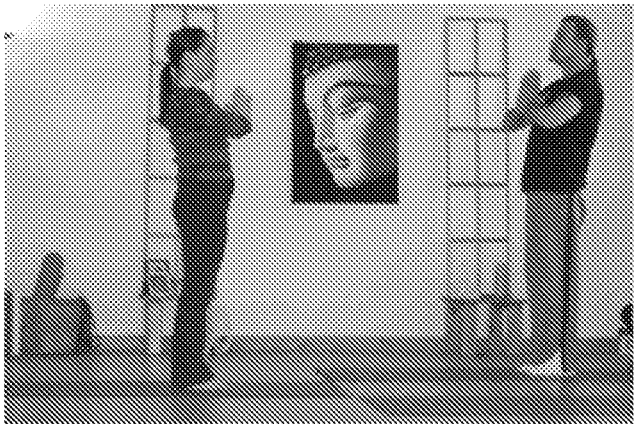
FIG. 1B Prior art
Figure 1C:
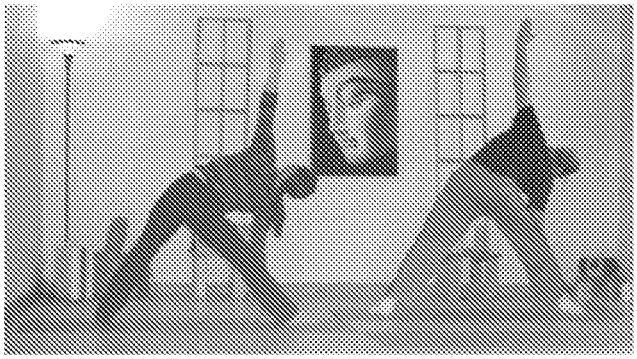
FIG. 1C Prior art
Figure 2A:
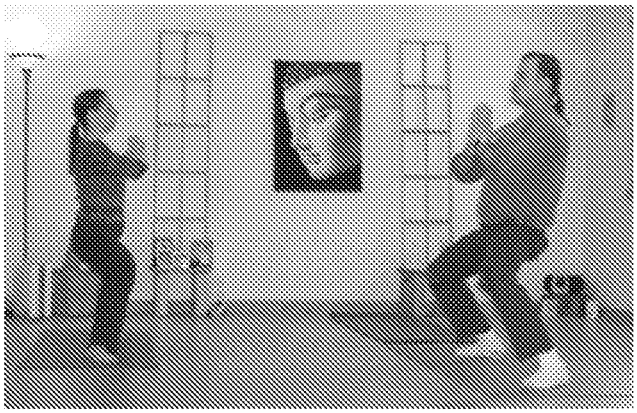
FIG. 2A Prior art
FIGS. 2A-2C show yoga positions on a traditional yoga mat in a side-facing position.
Figure 2B:
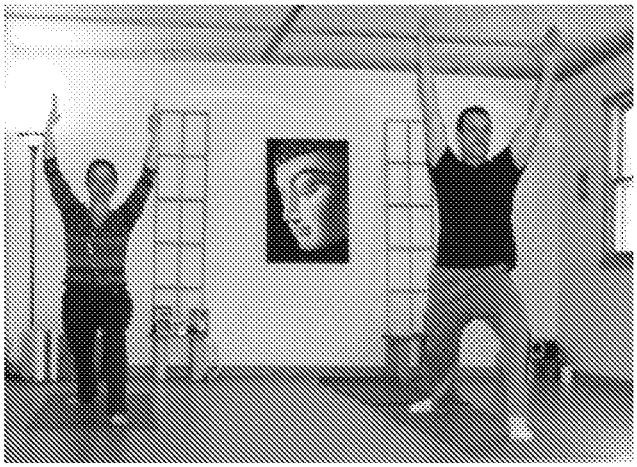
FIG. 2B Prior art
Figure 2C:
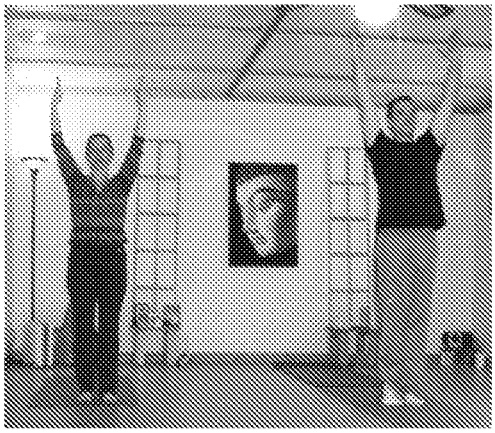
FIG. 2C Prior art
Figure 2D:
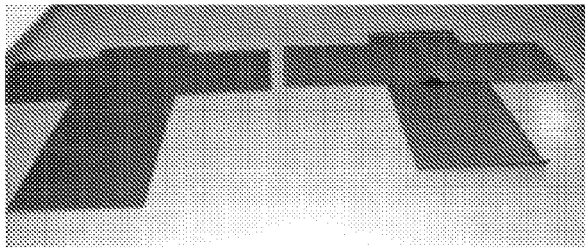
FIG. 2D shows a side-by-side example of a yoga mat designed according to embodiments of the invention described herein positioned next to two traditional yoga mats crossed over one another.
Figure 3:
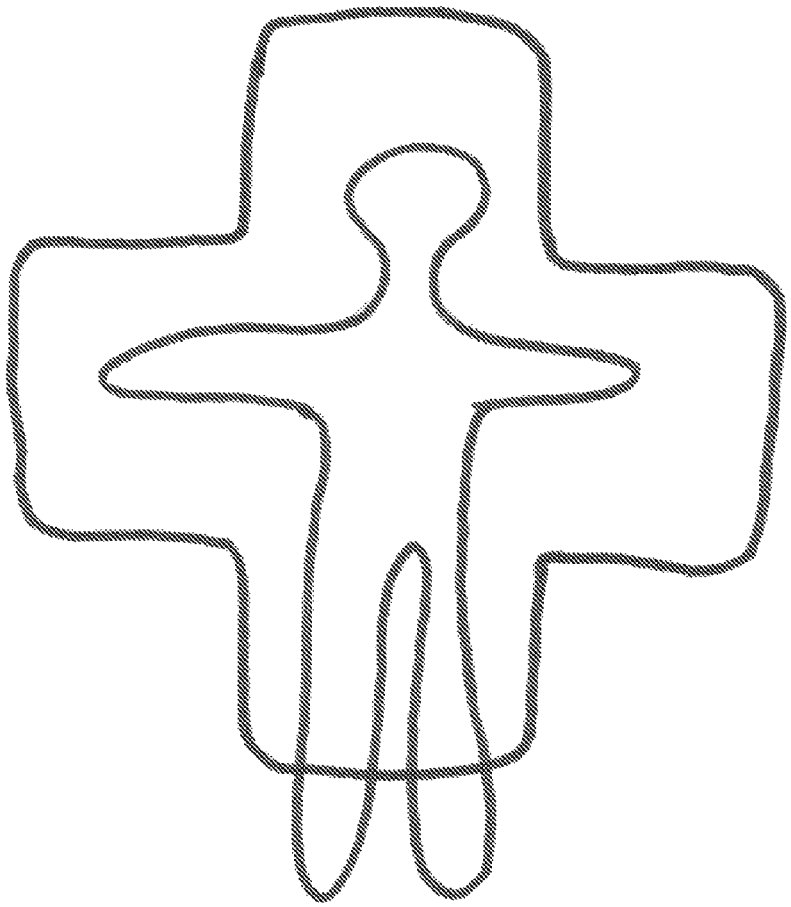
FIG. 3 Prior art
FIG. 3 shows a plus-sign yoga mat of the prior art.
Figure 4:
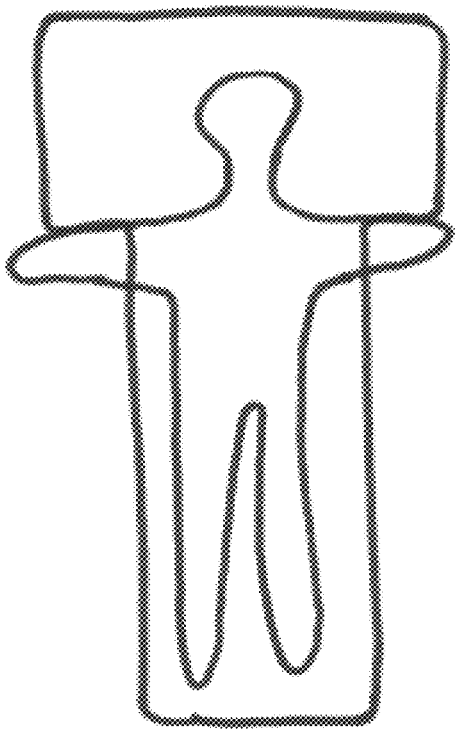
FIG. 4 Prior art
FIG. 4 shows a capital T-shape yoga mat of the prior art.
Figure 5A:
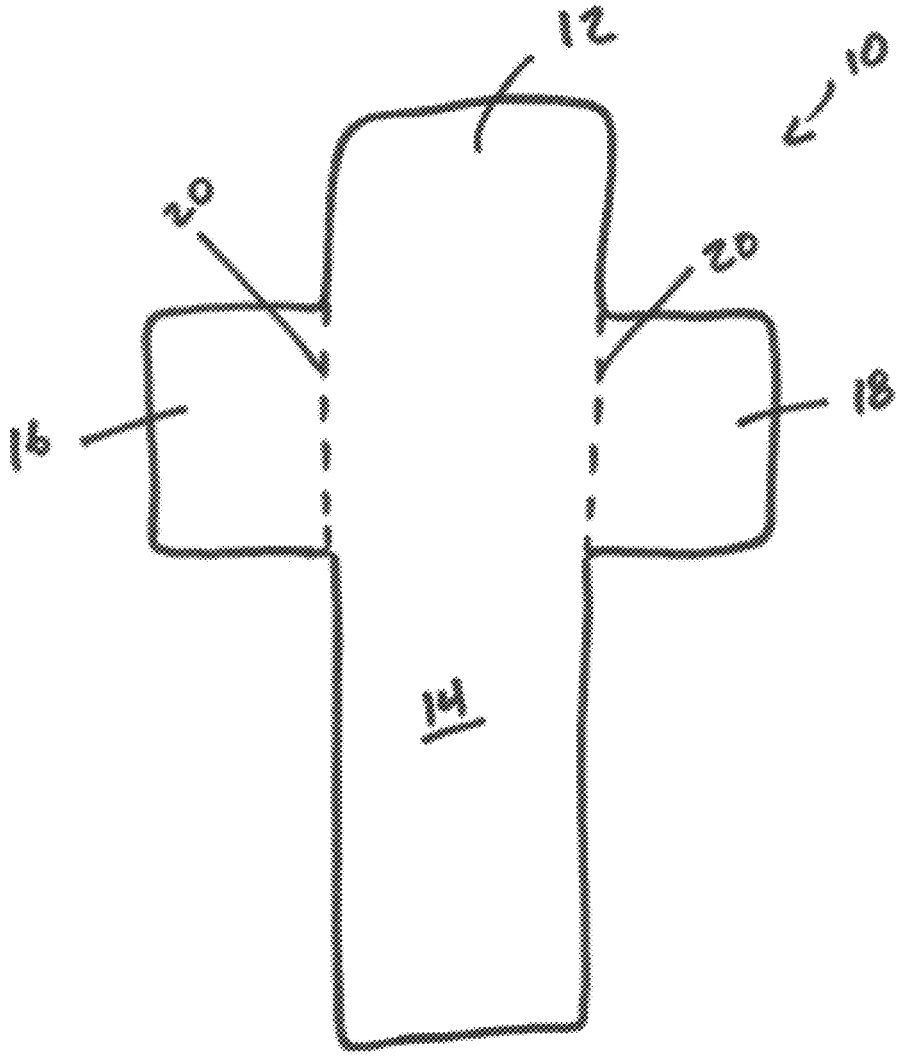
FIG. 5A shows one embodiment of a yoga mat according to embodiments of the invention.
Figure 5B:
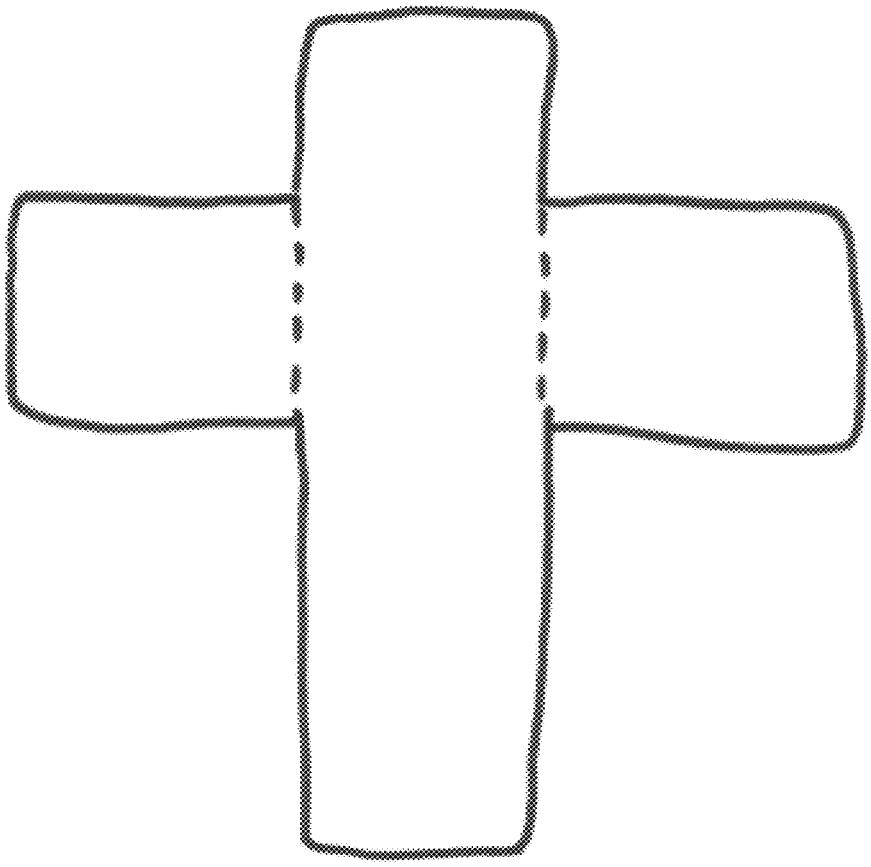
FIG. 5B shows an embodiment of a yoga mat with longer T-arms.
Figure 5C:
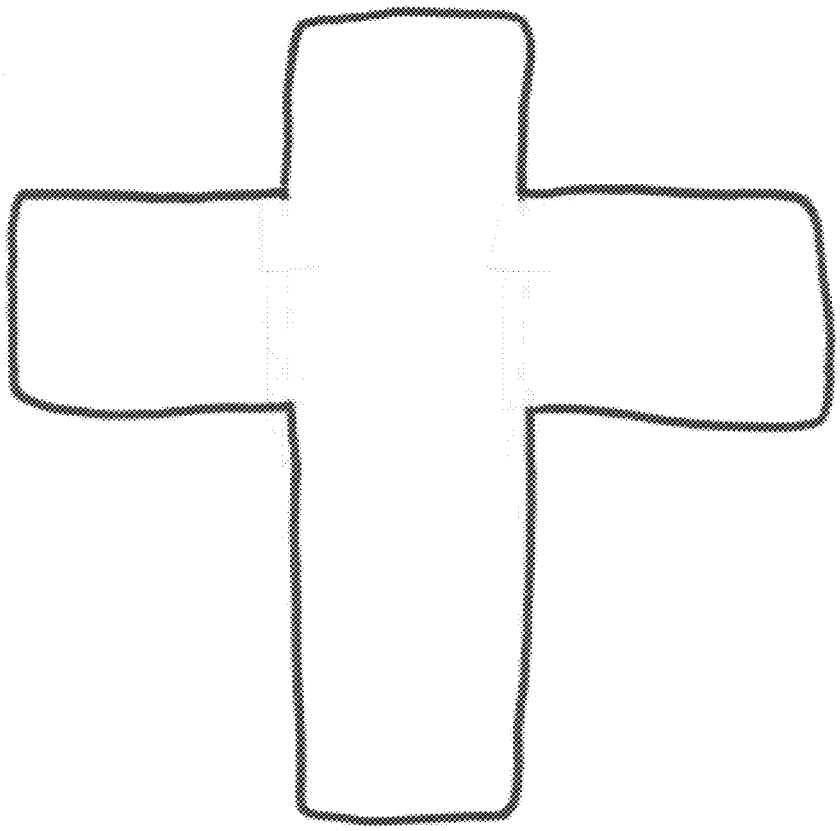
FIG. 5C shows an embodiment of a yoga mat without score lines.

As shown in FIGS. 5A-C, the cross shaped mat 10 provides an elongate portion that includes a head portion 12, a straight lower body portion 14, with two cross arm portions 16, 18 extending therefrom. Head portion 12 is generally considered the portion of the mat body that is above the point at which cross arm portions 16, 18 join mat body. It is generally dimensioned in order to provide an area for the user's head to be positioned during floor postures. The shape of the mat 10 is generally a small letter "t", such that the head portion 12 has a shorter length than the remainder of the lower body portion 14. This results in the mat 10 having a small "t" or cross-shaped appearance; accordingly, specific embodiments of the mat may be referred to as the "cross mat." FIG. 5A shows a mat having a total width across cross arms 16, 18 that is shorter than the total mat length. FIG. 5B shows a mat having a width across cross arms 16, 18 that is about the same as the total mat length.

In a specific embodiment, the entire mat 10 is a one-piece, integral unit. In other words, the cross arm portions 16 and 18 are not intended to removable from the straight body portion 14, and this construction provides a one-piece mat without extra parts or Velcro® seams. The cross arm portions 16, 18 are either cut from the same piece of material from which the mat is cut during manufacture, or they may be cut separately and heat welded, pressed, glued, or otherwise permanently and non-removably secured to the mat. (In an alternate embodiment, it may be possible to provide removable arm portions 16, 18 such that arm portions can be re-positioned anywhere along mat body.)

The mat is typically made from a piece of material that is cut from a large ream of mat material such that all portions of the mat have the same thickness. In a particularly preferred embodiment, the mat is cut from material having ⅛ inch thickness.

Figure 6:
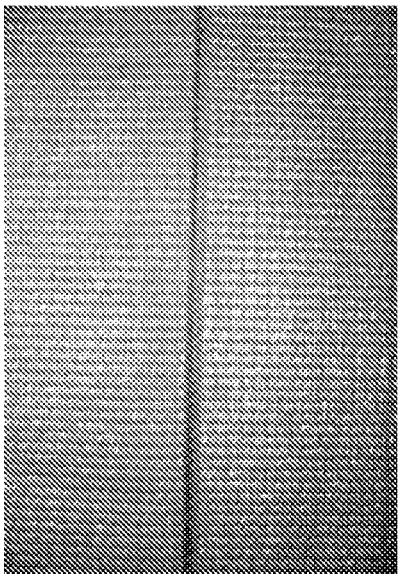
FIG. 6 shows a close up view of a yoga mat with score lines.

Once mat 10 is formed, fold lines 20 are formed between cross arm portions 16, 18 and body portion 14. An example of one type of fold line 20 is shown in FIG. 6, as a score line. Fold line 20 is positioned along an axis where each cross arm extends from the mat body. The score line 20 may be a slight score across the material at the cross position, which creates a line of weaknesses in a longitudinal direction along the length of mat, but such that cross arm portions 16, 18 remain non-removably attached to mat 10. In other words, the fold or score line 20 does not affect the strength of the mat, but allows for easier folding and rolling of the mat. Fold line 20 may be crease, a heat pressed area, a score line or partially scored portion, a thin area where the mat material is thinner, a line of weakness, a dotted line area, or the like, or any other demarcation that identifies an area of weakness or thinness that makes cross arm portions easier to fold inward. Fold lines 20 may be considered an area or short line where the thickness of the mat is slightly decreased in order to ease folding, although any manufacturing technique that may be used to create an arm portion that folds inwardly may be used to create fold lines 20. It should be understood that any number of manufacturing techniques may be appropriately identified and used within the scope of this invention. It is preferred that cross arm portions not be removable during the folding process, but that they remain reliably secured to the mat body 14. FIG. 5C shows an example of a mat embodiment without score lines 20.

Figure 7:
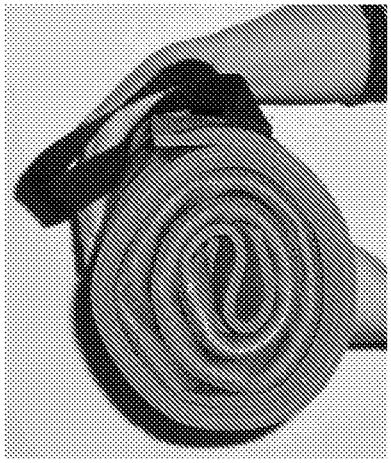
FIG. 7 shows a side view of a yoga mat according to various embodiments of the invention in a rolled configuration.
Figure 8A:
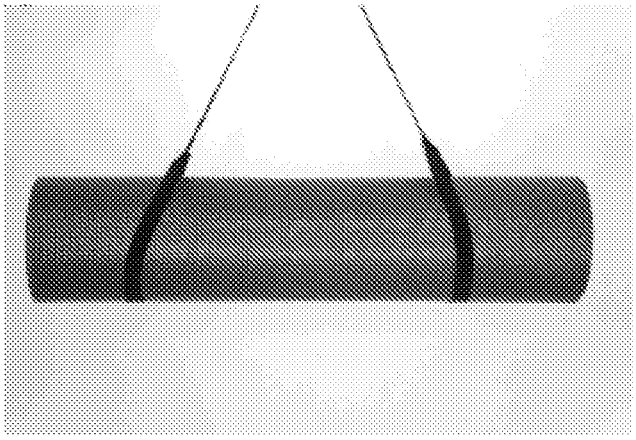
FIG. 8A shows a front view of the rolled yoga mat of FIG. 7.
Figure 8B:
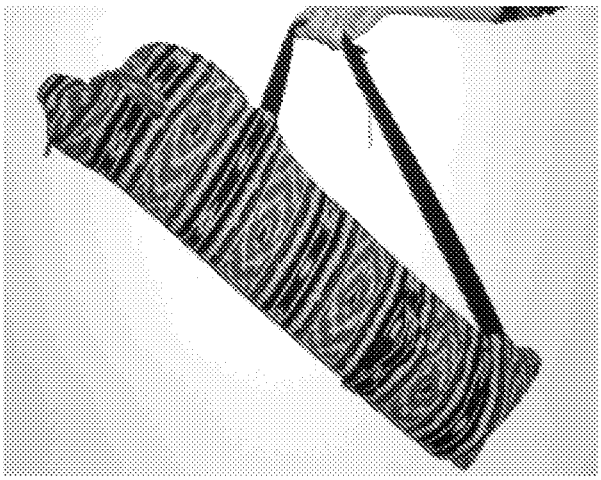
FIG. 8B shows the yoga mat of FIG. 8A in a yoga mat bag.

After use of the mat, the user may fold cross arm portions 16, 18 into or toward the body 14 of the mat, and the roll the mat up from either the head portion 12 or the end of the body portion 14. Although cross arm portions 16, 18 add a slight amount of additional material to the rolled mat, as shown in FIG. 7, the rolled mat is virtually the same size as a traditional mat, enabling it to fit into the popular carry straps and yoga bags currently on the market, examples of which are shown in FIGS. 8A and 8B.

It should be understood that any number of mat thicknesses and mat materials are possible for use and considered within the scope of this invention. Exemplary but non-limiting examples of some mat materials include plastic, vinyl, rubber, polyvinyl chloride, foam, ethylene vinyl acetate (EVA) foam, thermoplastic elastomer (TPE) foam, latex, phthalates, polymer environmental resin (PER), woven fabrics or fibers, (such as hemp, wool, and so forth), or any other appropriate material. Exemplary but non-limiting examples of some material thicknesses include ⅛ inch and ¼ inch, which are standard options, but it should be understood that thinner materials or and thicker materials may also be used. For example, potential material thicknesses may also be about 1/16 inch or about ½ inch.

In a specific embodiment, the length of the mat between the top of head portion 12 and the point at which cross arm portions 16, 18 begin may be about six inches to about two feet, although longer and shorter dimensions are possible. The length of body portion 14 between the point at which cross arm portions 16, 18 begin and the lower end of mat may be about four feet to about six feet, although longer and shorter dimensions are also possible, depending upon manufacturer and user preference.

The entire total longitudinal length of mat 10 may be generally about 6 feet long, which is standard in the yoga industry, although shorter and longer lengths may be provided. It is possible to provide mats that are only about five feet long, or mats that are as long as about eight feet long or longer. The entire width of body portion 14 (except where cross arms are located) is about two feet, which is also the standard, although shorter and longer lengths may also be provided. The length of each individual cross arm portion (from the point at which cross arm portions meet body portion to the outward edges) may be about two feet, although they may range anywhere from about 12 inches to about 3 feet. In a particularly preferred embodiment, cross arm portions are each two feet long, and combined with a mat width along body portion of two feet, provide a total width of the mat across the cross arm portions of about six feet. Of course, longer and shorter lengths may be possible. It is possible to provide mats that are only about five feet in width, or mats that have widths as long as about eight feet long or longer across arm portions. FIG. 5B shows one example of a mat that is about 6 feet long by about 6 feet wide across cross arm portions 16, 18. FIG. 5A shows one example of a mat with shorter cross arm portions.

It is generally desirable for cross arm portions 16, 18 to be sized, shaped, and dimensioned such that a user's arms may be spread open during a floor posture and remain on and supported by cross arm portions. They are also designed to accommodate a user's legs when spread at least about hip's distance apart in a facing forward standing position. Examples of postures done on cross mat 10 vs. a traditional straight yoga mat are illustrated by FIGS. 9-14.

Figure 9A:
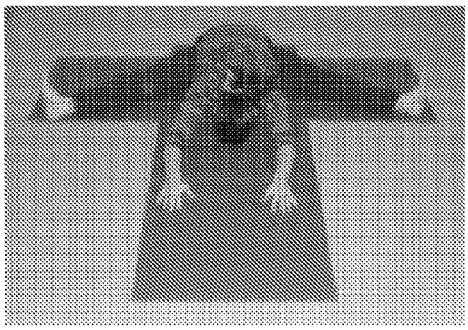
FIGS. 9A and 9B show examples of one yoga posture on a cross mat compared to a yoga posture on a traditional mat.
Figure 9B:
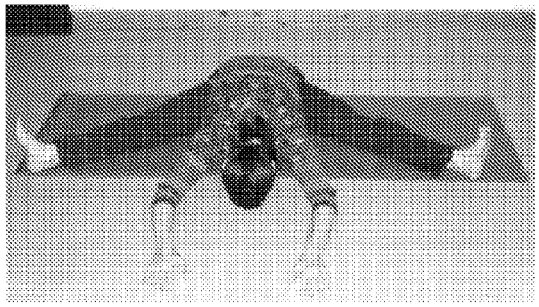
Figure 10A:
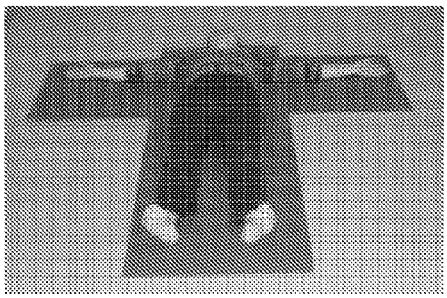
FIGS. 10A and 10B show examples of another yoga posture on a cross mat compared to a yoga posture on a traditional mat.
Figure 10B:
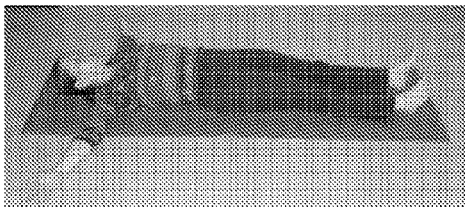
Figure 11A:
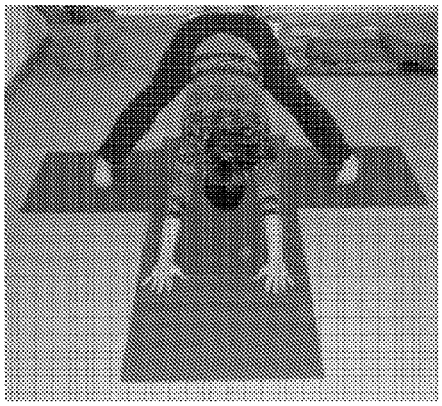
FIGS. 11A and 11B show examples of a further yoga posture on a cross mat compared to a yoga posture on a traditional mat.
Figure 11B:
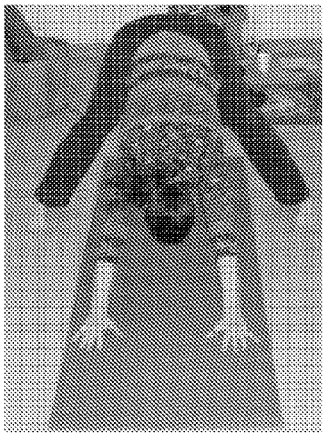
Figure 12A:
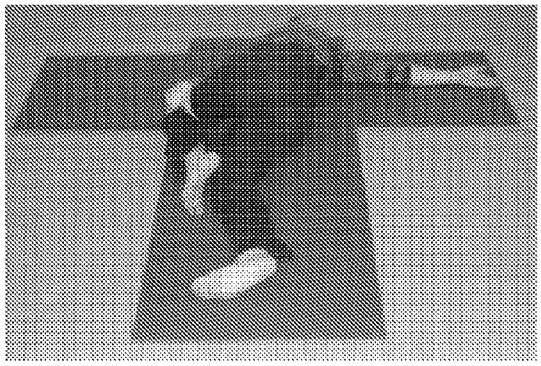
FIGS. 12A and 12B show a further example of a yoga posture on a cross mat compared to a yoga posture on a traditional mat.
Figure 12B:
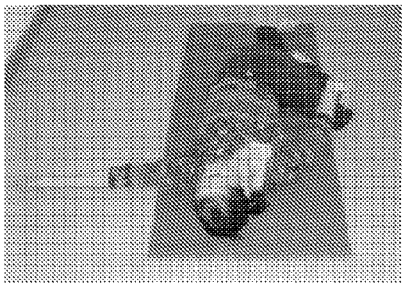

The benefits provided by the cross-mat shape are clear. For example, as shown in FIG. 9A, in wide angle pose (where the participant's legs are outstretched and the body is leaning forward with the head and hands stretched forward), the cross mat 10 allows the legs, forehand, and arms to stay on the mat. By contrast, the same pose done on a traditional yoga mat allows the forehand and arms to touch the floor. Similarly, as shown in FIG. 10A, in T pose (where the participant lies on his/her back on the floor with the arms stretched out to either side), the cross mat 10 allows the legs and arms to stay on the mat. By contrast, the same pose done on a traditional yoga mat allows the arms to hang off the mat and touch the floor. Similar benefits with other poses are shown in FIGS. 11A vs. 11B (wide leg downward dog) and 12A vs. 12B (spinal twist). It is more comfortable, natural, and sanitary to do postures with a mat under all body parts.

Figure 13A:
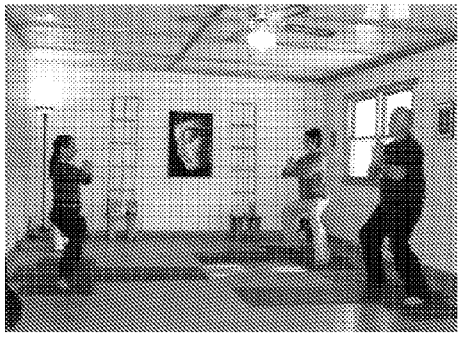
FIGS. 13A and 13B show examples of instructor/student configurations using a cross mat compared to using traditional mats.
Figure 13B:
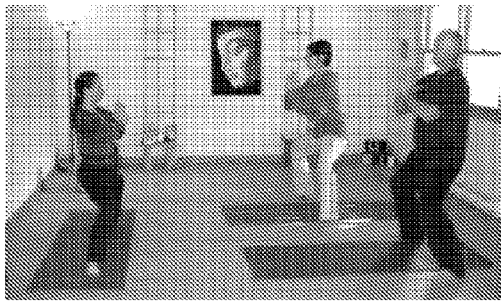

Advantages in the classroom environment are also evident in FIGS. 13-14. FIG. 13A shows instructor and participants using a cross mat for Standing Goddess pose, which allows the instructor and students to face one another, while all participants' feet remain on the mat. FIG. 13B shows one example of a challenge created by the use of traditional yoga mats for this same pose—in this instance, the students' feet extend off of the mat. If the students were to turn their mat the same as the instructor, this would not be optimal for some other poses and vise versa.

Figure 14A:
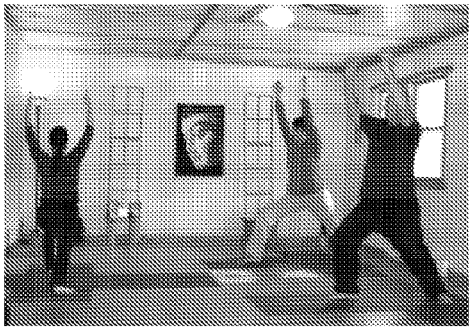
FIGS. 14A-B show examples of a yoga posture on a cross mat.
Figure 14B:
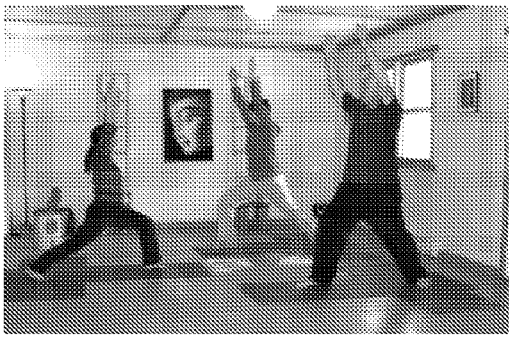
Figure 14C:
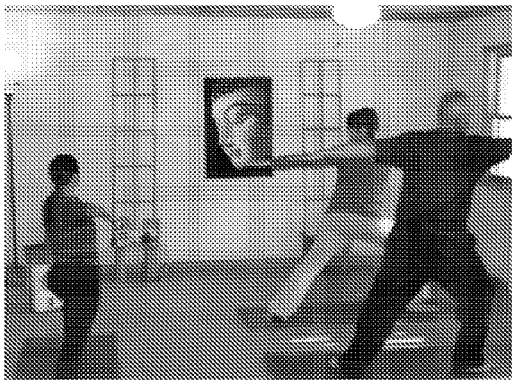
FIG. 14C shows similar yoga postures on a traditional mat.

FIGS. 14A and 14B show instructor and participants using a cross mat in Warrior I pose, and illustrate how the instructor can demonstrate the same pose in two different angles. By contrast, FIG. 14C shows how doing a Warrior II pose with a traditional yoga mat requires students to look over their shoulders to see the instructor. The instructor could move over to the side of the room for this pose in order to be in front of the students, but the instructor would be there without a mat and the movement causes an awkward break in the flow of class.

In order to correct this while using a traditional straight mat, the students would have to interrupt class to flip their mat long ways. But using a cross mat allows the participants to engage in a number of poses facing various sides of the room, while still maintaining all body parts on the mat rather than the bare floor and without straining to see the instructor.

The mats may be provided in solid colors or patterns or in multiple colors or patterns to make them visually interesting and increasingly marketable. Designs or insignia, monograms, yoga studio names, marketing materials, or any other desired indicia may be applied, painted, screen printed, heat pressed, or otherwise ingrained onto the mats. It may also be desirable to provide a skid resistant coating or texture onto one or both surfaces of the mat. The mat may also be provided is varying sizes, and thicknesses, such that particular personal or studio preferences may be accommodated.

Figure 15:
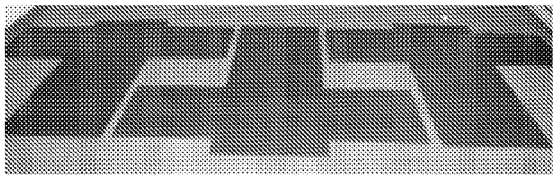
FIG. 15 shows an example of one potential arrangement of a number of cross mats.

A further benefit of the cross mat is shown in FIG. 15. Because of its unique shape and construction, multiple cross mats 10 may be placed on a studio floor relatively close to one another (e.g., in the example shown, they may be alternately positioned), minimizing the space taken up and allowing more yoga participants to join a class than with larger square or oval mats, while still maintaining a modicum of personal space. For example, because the mat is cross shaped (or shaped like a small letter "t") and not a plus sign or an "x", it takes up virtually no additional space in the studio. The students do not have to wonder if their mats are too close to one another, because the cross mat is shaped and configured to provide support for all body parts in almost all yoga positions. Class participants using cross mats need not be concerned whether or not they are spaced far apart enough from one another to keep their hands and feet from touching one another in floor postures. The cross mat takes all the guesswork out of mat positioning prior to class.

A further advantage of the cross mat embodiments described herein is that the arms may be folded inward to create additional padding or a padded area. This can be useful in studios that have hard floors, or for certain poses that lend themselves to extra padding for the head, knees, or buttocks. Frequently, students will fold up a blanket to place under knees, ankles, head, elbows or double up mats to create the desired padding in certain areas. This means that the studio has to purchase and maintain these extra items on hand, or the students have to purchase and bring them to class themselves. Additionally, stopping class to allow each student to retrieve and position the desired padding element can be disruptive to the class flow, and can unnecessarily lengthen class times. However, FIGS. 16-21 illustrate how the cross arm portions of the cross mat can be "folded in" to solve this problem. This provides extra padding for forehead, elbows, or knees.

Figure 16:
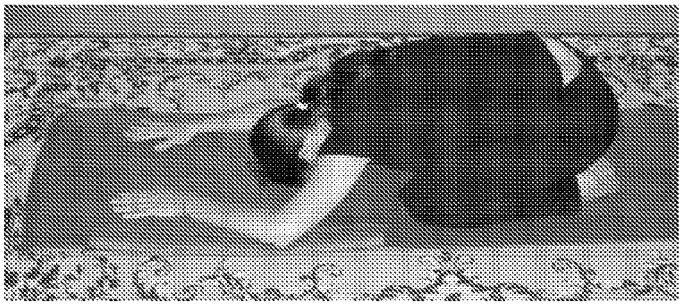
FIGS. 16-21 shows examples of various yoga postures on a cross mat having the arms folded inward to create padding or a padded area.
Figure 17:
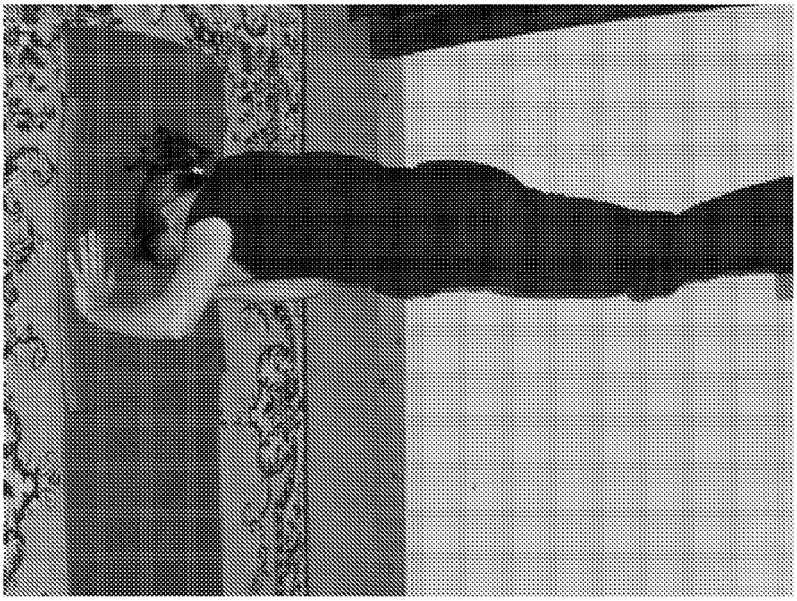
Figure 18:
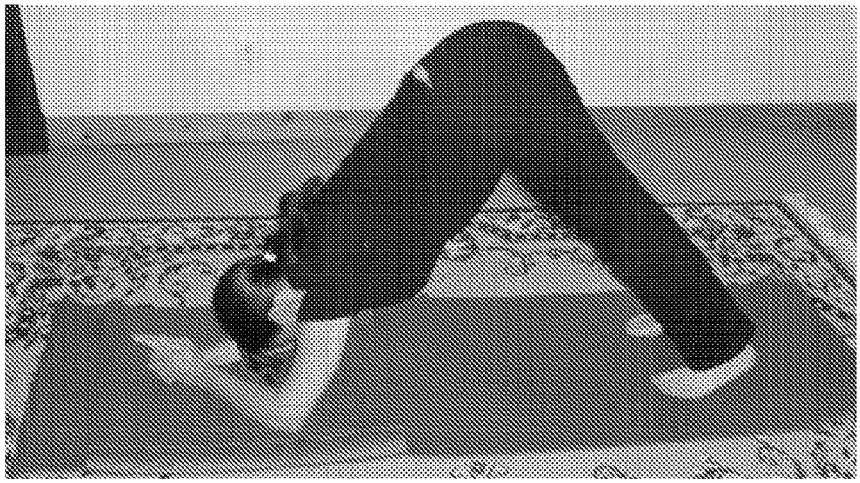
Figure 19:
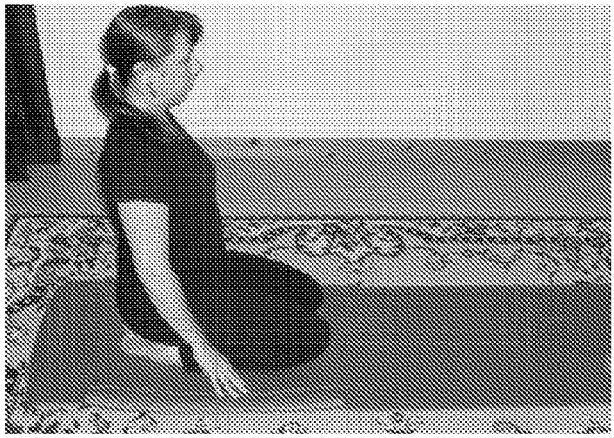
Figure 20:
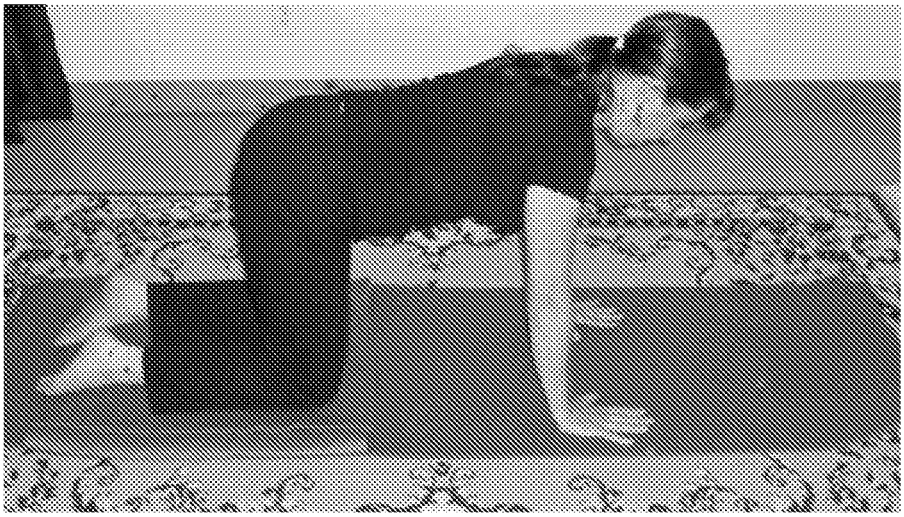
Figure 21:
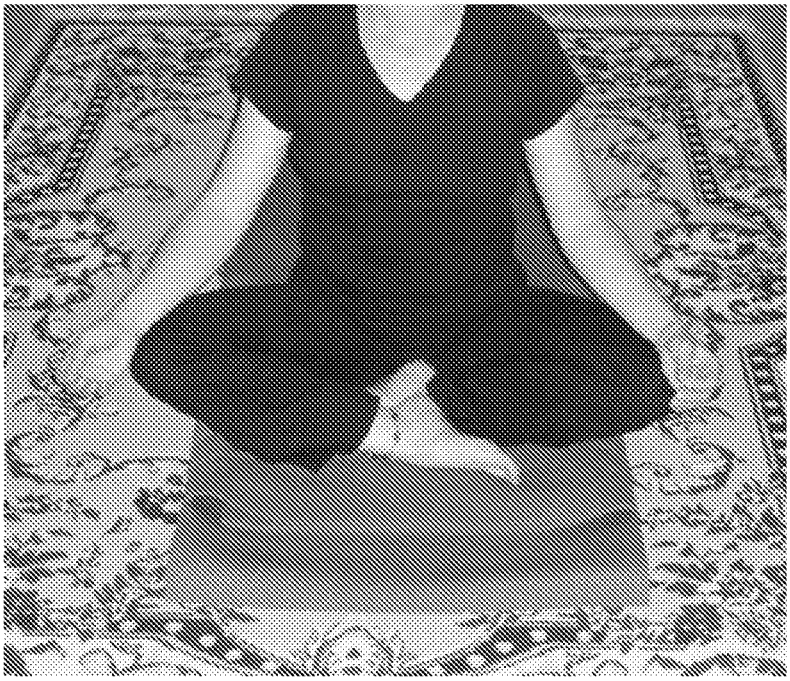

For example, in a poses such as child's pose and head stands, shown in FIGS. 16 and 17, the practitioner's forehead or the crown of the head is on the ground. Being able to fold the mat arms inwardly to create a padded area on which the head can rest is a distinct advantage over prior art mats. Other poses for which padding would be preferable are illustrated in FIGS. 18-21. These poses show the mat inwardly folded to protect elbows (FIG. 18) and knees (FIGS. 19 and 20). FIG. 21 illustrates how a padded portion formed by folded in cross arms is a benefit for sitting meditation, where often ankles and/or buttocks can become uncomfortable on a single mat on a hard or wood floor.

Further uses for the cross mat may be discovered and are considered within the scope of this invention. Changes and modifications, additions and deletions may be made to the structures and methods recited above and shown in the drawings without departing from the scope or spirit of the invention.

What is claimed is:

1. A one-piece, integral yoga mat, comprising:

(a) an elongate yoga mat body portion;

(b) first and second cross arm portions extending from the elongate yoga mat body portion and integrally formed with the elongate yoga mat body portion such that the cross arms are not removable therefrom, wherein the cross arms extend from the yoga mat body portion in such a way as to define a head portion and a lower portion, wherein the head portion has a length that is shorter than the lower portion, further comprising a score line formed where each cross arm extends from the elongate yoga mat body portion, wherein each score line defines a line where the thickness of the yoga mat is decreased in order to ease inward folding of the first and second cross arm portions.

2. The yoga mat of claim 1, wherein the cross arms are closer to a head portion end of the mat than to a lower portion end of the mat.

3. The yoga mat of claim 1, wherein the cross arms extend from the mat body portion to form a mat having a lower-case letter "t" shape.

4. The yoga mat of claim 1, wherein the cross arms extend from the mat body portion to form a mat having a cross shape.

5. The yoga mat of claim 1, wherein each score line comprises a, a line of weakness, an area of lesser material, a dotted area, a crease, a heat pressed area, or any combination thereof.

6. The yoga mat of claim 1, wherein the mat has a mat length along the head portion to the lower portion, and a mat width from one end of the first cross arm to an end of the second cross arm.

7. The yoga mat of claim 6, wherein the mat width is shorter than the mat length.

8. The yoga mat of claim 6, wherein the mat width is about equal to the mat length.

9. The yoga mat of claim 1, wherein the length of the mat between a top of the head portion and a point at which cross arm portions begin is about six inches to about two feet.

10. The yoga mat of claim 1, wherein the length of body portion between a point at which cross arm portions begin and a lower end of mat is about four feet to about six feet.

11. The yoga mat of claim 1, wherein each cross arm portion is about two feet long, the width of the mat body portion is about two feet long, resulting in a total width of the mat across the cross arm portions of about six feet.

12. The yoga mat of claim 1, wherein the mat comprises plastic, vinyl, rubber, polyvinyl chloride, foam, ethylene vinyl acetate (EVA) foam, thermoplastic elastomer (TPE) foam, latex, phthalates, polymer environmental resin (PER), woven fabrics or fibers, or any combination thereof.

13. The yoga mat of claim 1, wherein the cross arm portions are configured to be folded inward during mat folding or for mat activities requiring extra padding.

* * * * *